US009712930B2

(12) United States Patent
Mustiere et al.

(10) Patent No.: US 9,712,930 B2
(45) Date of Patent: Jul. 18, 2017

(54) PACKET LOSS CONCEALMENT FOR BIDIRECTIONAL EAR-TO-EAR STREAMING

(71) Applicant: Starkey Laboratories, Inc., Eden Prairie, MN (US)

(72) Inventors: Frederic Philippe Denis Mustiere, Chaska, MN (US); Ivo Merks, Eden Prairie, MN (US); Tao Zhang, Eden Prairie, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 14/854,716

(22) Filed: Sep. 15, 2015

(65) Prior Publication Data

US 2017/0078807 A1 Mar. 16, 2017

(51) Int. Cl.
*G10L 19/005* (2013.01)
*H04R 25/00* (2006.01)

(52) U.S. Cl.
CPC ..... *H04R 25/554* (2013.01); *G10L 19/005* (2013.01); *H04R 25/552* (2013.01)

(58) Field of Classification Search
CPC ..... H04R 2225/55; H04R 2225/41; H04R 2460/03; G10L 19/005
See application file for complete search history.

(56) References Cited

U.S. PATENT DOCUMENTS 7,117,156 B1 * 10/2006 Kapilow ..... G10L 19/005 370/281
7,924,704 B2 * 4/2011 Dowdal ..... H04L 65/80 370/216
2002/0138795 A1 * 9/2002 Wang ..... G10H 1/0058 714/707
2005/0091048 A1 * 4/2005 Thyssen ..... G10L 19/005 704/223
2005/0166124 A1 * 7/2005 Tsuchinaga ..... G10L 19/005 714/776
2006/0171373 A1 * 8/2006 Li ..... G10L 19/005 370/352

(Continued)

OTHER PUBLICATIONS

Bertrand, Alexander, "Applications and trends in wireless acoustic sensor networks: a signal processing perspective", Communications and Vehicular Technology in the Benelux (SCVT), 2011 18th IEEE Symposium on. IEEE, (2011), 6 pgs.

*Primary Examiner* — Jialong He
(74) *Attorney, Agent, or Firm* — Schwegman, Lundberg & Woessner, P.A.

(57) ABSTRACT

Embodiments of packet loss concealment in a hearing assistance device are generally described herein. A method for packet loss concealment can include receiving, at a first hearing assistance device, a first encoded packet stream from a second hearing assistance device and a signal frame. The method can include encoding, at the first hearing assistance device, the signal frame and determining, at the first hearing assistance device, that a second encoded packet stream was not received from the second hearing assistance device within a predetermined time. In response to determining that the second encoded packet stream was not received, the method can include decoding, at the first hearing assistance device, the encoded signal frame, and outputting the signal frame and the decoded signal frame.

20 Claims, 5 Drawing Sheets

(56) References Cited

U.S. PATENT DOCUMENTS

| | | | | |
|---|---|---|---|---|
| 2007/0055498 | A1* | 3/2007 | Kapilow | G10L 19/005 704/206 |
| 2007/0274550 | A1* | 11/2007 | Baechler | H04R 25/554 381/315 |
| 2011/0150252 | A1* | 6/2011 | Solum | H04W 56/0035 381/314 |
| 2012/0101814 | A1* | 4/2012 | Elias | G10L 19/005 704/207 |
| 2012/0314890 | A1* | 12/2012 | El-Hoiydi | H04R 25/558 381/315 |
| 2013/0129126 | A1* | 5/2013 | Callias | H02J 7/345 381/315 |
| 2014/0056451 | A1* | 2/2014 | El-Hoiydi | H04R 25/554 381/315 |
| 2014/0119478 | A1* | 5/2014 | Fazeldehkordi | G10L 19/005 375/341 |
| 2014/0143582 | A1 | 5/2014 | Kindred et al. | |
| 2014/0169599 | A1* | 6/2014 | Solum | H04R 25/554 381/315 |
| 2014/0170979 | A1* | 6/2014 | Samanta Singhar | G10L 25/60 455/41.2 |
| 2015/0255079 | A1* | 9/2015 | Huang | G10L 19/0017 704/500 |
| 2015/0326984 | A1* | 11/2015 | Haubrich | H04R 25/554 381/315 |
| 2016/0088408 | A1* | 3/2016 | Solum | H04R 25/554 381/315 |

* cited by examiner

PACKET LOSS CONCEALMENT FOR BIDIRECTIONAL EAR-TO-EAR STREAMING

FIELD OF THE INVENTION

Disclosed herein are devices and methods for packet loss concealment in binaural audio devices, and in particular for bidirectional ear-to-ear streaming in binaural hearing assistance devices.

BACKGROUND

Adaptive differential pulse-code modulation (ADPCM) is used in the context of audio streaming to improve hearing assistance device functionality when streaming from ear-to-ear. ADPCM has a low latency, good quality, a low bitrate, and low computational requirements. However, one drawback to using ADPCM is that it is negatively affected by packet-loss. The negative impact on resulting audio quality when packet-loss occurs with ADPCM is not limited to the dropped packet, but also up to several dozens of milliseconds after the dropped packet.

When using ADPCM, the encoder and the decoder both maintain a certain state based on the encoded signal, which under normal operation and after initial convergence is the same. A packet drop causes the encoder and the decoder states to depart from one another, and the decoder state will take time to converge back to the encoder state once valid data is available again after a drop.

Packet-loss-concealment (PLC) techniques can be used to mitigate the error caused by packet loss. While there are multiple single-channel PLC techniques currently used, they are often slow and costly in terms of instructions per second used, and thus can be infeasible in a hearing assistance device setting.

SUMMARY

Disclosed herein are various devices and methods for packet loss concealment in binaural hearing assistance devices. Various method embodiments include receiving, at a first hearing assistance device, a first encoded packet stream from a second hearing assistance device, receiving, at the first hearing assistance device, a signal frame, and encoding, at the first hearing assistance device, the signal frame. In various embodiments, the methods include determining, at the first hearing assistance device, that a second encoded packet stream was not received from the second hearing assistance device within a predetermined time, and in response to determining that the second encoded packet stream was not received, decoding, at the first hearing assistance device, the encoded signal frame. In various embodiments the methods include outputting, at the first hearing assistance device, the signal frame and the decoded signal frame.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

BRIEF DESCRIPTION OF THE DRAWINGS

In the drawings, which are not necessarily drawn to scale, like numerals can describe similar components in different views. Like numerals having different letter suffixes can represent different instances of similar components. The drawings illustrate generally, by way of example, but not by way of limitation, various embodiments discussed in the present document.

DETAILED DESCRIPTION

The following detailed description of the present subject matter refers to subject matter in the accompanying drawings which show, by way of illustration, specific aspects and embodiments of the present subject matter in which the present subject matter can be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

Figure 1:
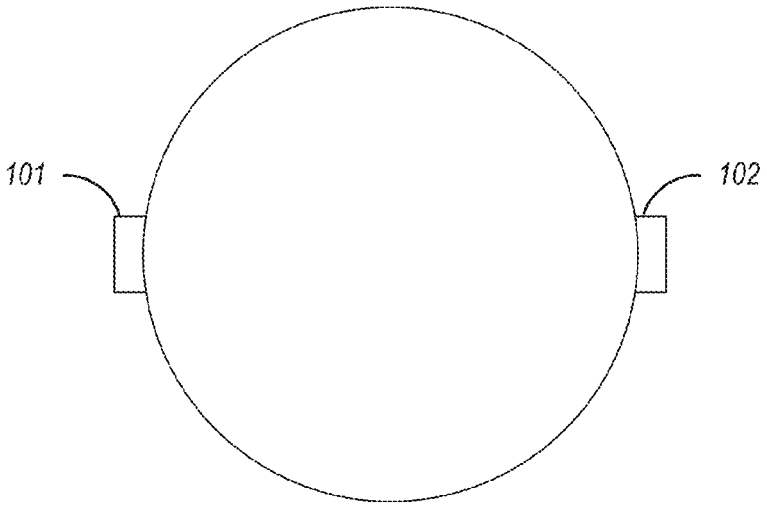
FIG. 1 shows a person wearing first and second binaural hearing assistance devices, according to various embodiments of the present subject matter.

FIG. 1 shows a person wearing a first binaural hearing assistance device 101 and a second binaural hearing assistance device 102, according to various embodiments of the present subject matter. The hearing assistance devices of FIG. 1 can be any type of hearing assistance device. For example, in the case where hearing assistance devices are hearing aids, the hearing aids can be of any type or of mixed types. For example, the devices can be one or more of in-the-ear devices, completely-in-canal devices, behind-the-ear devices, and receiver-in-canal devices (among others). The present subject matter is adapted to provide enhanced communications between the devices as set forth herein.

The first binaural hearing assistance device 101 and the second binaural hearing assistance device 102 can communicate with bidirectional ear-to-ear communications. The first binaural hearing assistance device 101 and the second binaural hearing assistance device 102 can exchange signals using the bidirectional ear-to-ear communication. Information captured by the first binaural hearing assistance device 101 and the second binaural hearing assistance device 102 can be generally correlated information when captured at each ear on the sides of the head of the person.

Figure 2:
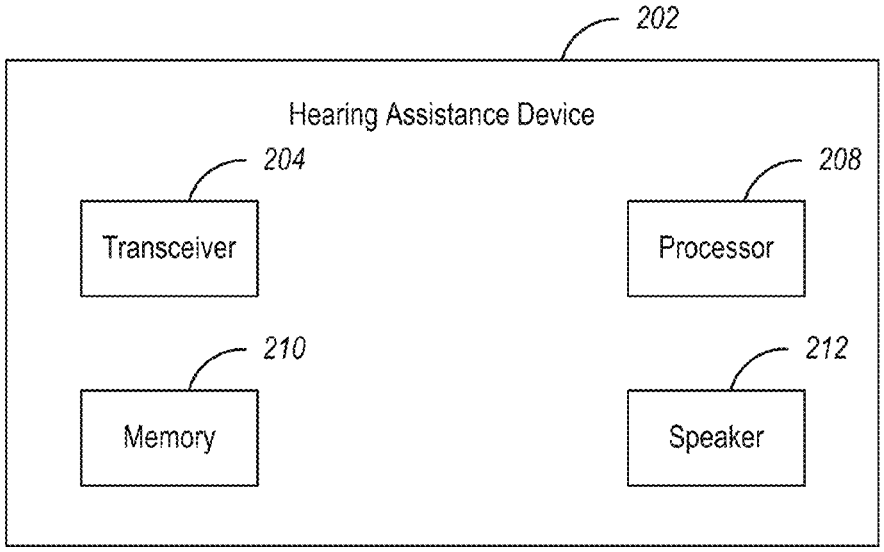
FIG. 2 shows a block diagram of a binaural hearing assistance device, according to various embodiments of the present subject matter.

FIG. 2 illustrates a block diagram of a hearing assistance device 202 in accordance with various embodiments of the present subject matter. For example, the hearing assistance device 202 can be used with a second hearing assistance device such as shown in FIG. 1. In various embodiments, the hearing assistance device 202 includes a radio transceiver 204, a processor 208, and memory 210. In various embodiments, the device 202 includes one or both of a speaker 212 (also known as a "receiver" in the hearing aid industry) and a microphone. The processor 208 processes sound signals in hearing assistance device 202. The processed signals and other information can be sent by the transceiver 204. For example, the transceiver 204 can be used to transmit a locally acquired signal frame to another hearing assistance device. The transceiver 204 is also used to receive the encoded packet stream from the second hearing assistance device and to receive a local signal frame.

When packet communications are used to convey packet information from a device on one ear to a device on the other ear, drops in packet communications can have a profound impact on reception of the signal. Adaptive differential pulse-code modulation (ADPCM) is useful for improving hearing assistance device communications when streaming from ear-to-ear, but is particularly susceptible to packet loss issues. Packet-loss-concealment (PLC) techniques mitigate the error caused by packet loss. The present disclosure includes examples using an ADPCM codec; however, it is understood that the present subject matter is not limited to ADPCM codecs and that other codecs may be used without departing from the scope of the present subject matter.

In various embodiments, the processor 208 or transceiver 204 (or combinations of both) are configured to determine if a packet is dropped during reception. One such example of packet drop detection from the received encoded packet stream is provided by the process flow of FIG. 4 below. The memory 210 can be used to store locally acquired signal frames in case one needs to be used to replace a dropped packet from the encoded packet stream received from the second hearing assistance device. The memory 210 can store one or more frames or packets for processing. In an example, the memory 210 can use a circular buffer to store the locally acquired signal frames or packets. The speaker 212 can be used to play audio based on the binaural processing of the locally acquired signal frame and the ADPCM decoded packet (e.g., a packet decoded from the encoded local signal frame or a packet decoded from the encoded packet stream received from the second hearing assistance device).

Figure 3:
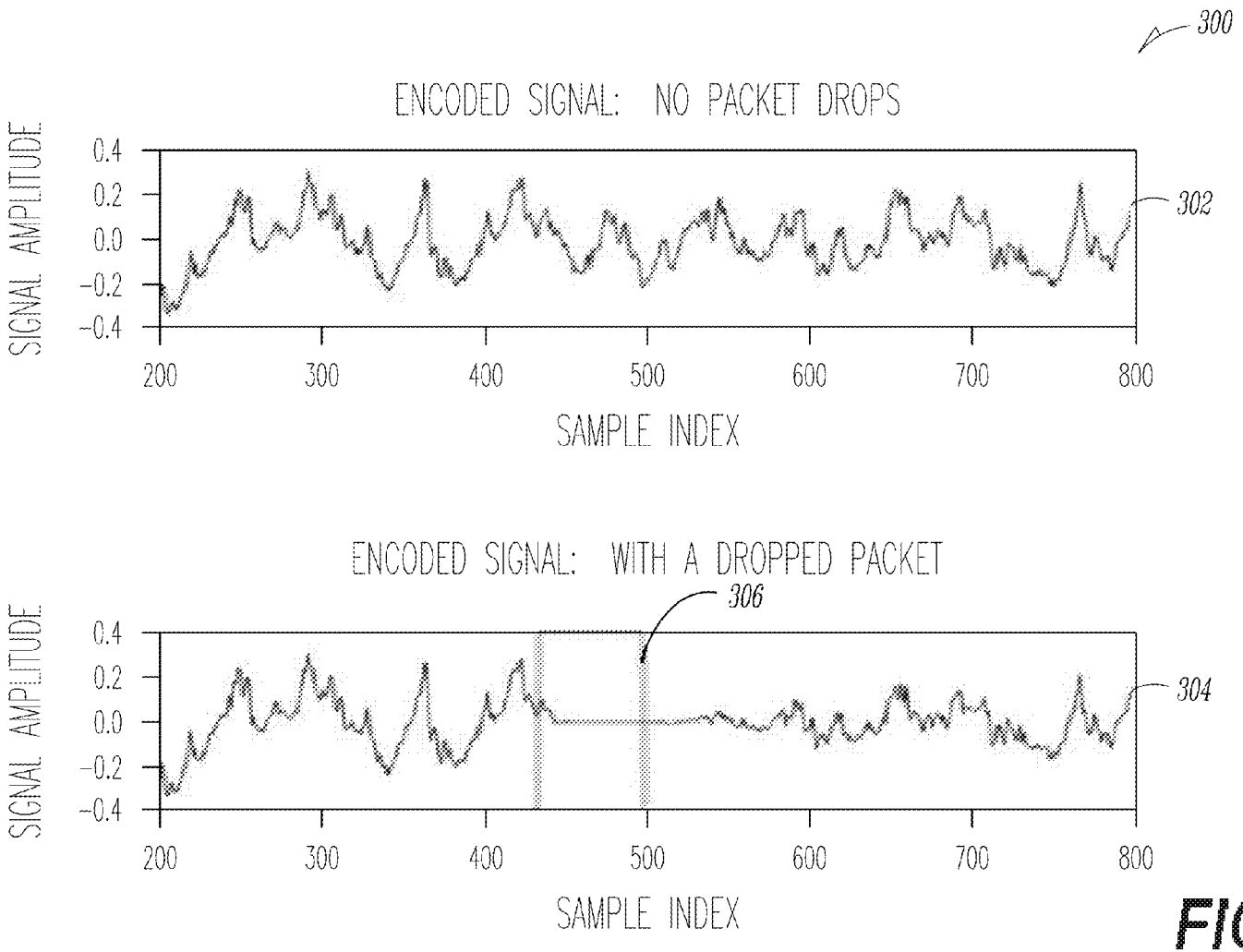
FIG. 3 illustrates generally a graph showing encoded signals over time, in accordance with various embodiments of the present subject matter.

FIG. 3 illustrates generally a graph 300 showing encoded signals over time using an ADPCM-based codec. The graph 300 includes a first encoded signal 302 over time with no packet loss and a second signal 304 over time with a packet loss. The packet loss is highlighted on the graph 300 of the second signal 304 with a box 306. As is evident from the second signal 304, the packet loss affects the signal not only at, but also after, the packet loss highlighted by box 306. The effect of the packet loss is not confined to just the window of the lost packets, but extends beyond the window.

Techniques to account for and eliminate effects of the packet loss typically have a significant computational cost and fail to take advantage of the ear-to-ear configuration. Techniques can include transmitting a single- or multi-channel audio signal from a certain physical location, such as from the first binaural hearing assistance device 101 to another physical location, such as second binaural hearing assistance device 102 of FIG. 1, where the second binaural hearing assistance device 102 can rely on the received information coming from the first binaural hearing assistance device 101 to reproduce the audio signal. Some of the packets transmitted by the first binaural hearing assistance device 101 do not reach the second binaural hearing assistance device 102, and thus the second first binaural hearing assistance device 102 uses various "filling", "repetition", or "extrapolation" techniques to try and reproduce the damaged information. This replacement signal is sometimes called a concealment frame, which can be generated by a number of approaches.

In certain setups, particularly in ADPCM-based setups, the generation of a "filler" signal is often not sufficient as it does not take care of state inconsistencies and creates long-lasting and highly audible artifacts. A better approach includes re-encoding a synthetic concealment frame at the decoder. This allows for the decoder state to keep updating, and an appropriate "filler" signal to be applied. However, a preferred outcome is that the decoder state will not differ much from the encoder state at the end of the frame, leaving possible inconsistencies. This technique can be unreliable and computationally costly.

Figure 4:
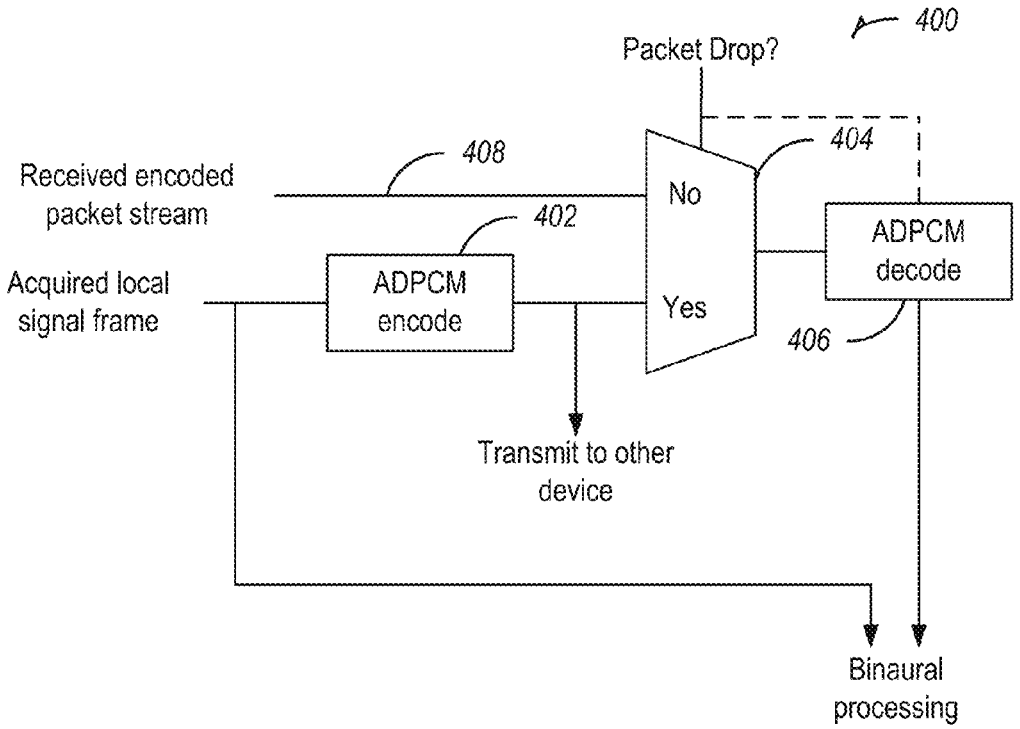
FIG. 4 illustrates generally a process flow for packet loss concealment at a hearing assistance device in accordance with various embodiments of the present subject matter.

FIG. 4 illustrates generally a process flow 400 for packet loss concealment at a first hearing assistance device, such as the first binaural hearing assistance device 101 of FIG. 1 in accordance with some embodiments of the present subject matter. The first hearing assistance device can generally communicate with a second hearing assistance device in a bidirectional ear-to-ear hearing assistance device system. In the process flow 400, the first hearing assistance device receives an encoded packet stream 408 from the second hearing assistance device, such as the second binaural hearing assistance device 102 of FIG. 2 (e.g., using a wireless receiver or transceiver, such as transceiver 204 of FIG. 2) and the first hearing assistance device can acquire a local signal frame. For example, the local signal frame can be acquired from an audio signal received at the first hearing device, such as in an audio stream. The local signal frame is encoded using ADPCM at block 402. The encoded signal frame is then transmitted to the second hearing assistance device and stored locally at the first hearing assistance device, such as in memory 210 of FIG. 2. The first hearing assistance device determines, such as by using the processor 208 of FIG. 2, at decision block 404 whether the received encoded packet stream 408 from the second hearing assistance device has a dropped packet (e.g., a packet is missing) corresponding to the locally acquired signal frame. When the encoded packet stream 408 includes the packet corresponding to the locally acquired signal frame (e.g., the packet is not dropped), then the first hearing assistance device decodes the encoded packet stream 408 at that packet using ADPCM at block 406. When the encoded packet stream 408 is missing the packet corresponding to the locally acquired signal frame (e.g., the packet is dropped), the first hearing assistance device decodes the encoded signal frame (from the locally acquired signal frame) using ADPCM at block 406. From block 406, either output is used with the locally acquired signal frame as the other component for binaural processing. A similar mirrored technique can be used by the second hearing assistance device if a packet is dropped from the first hearing assistance device.

The process flow 400 shown in FIG. 4 describes a technique that uses either the latest received packet of encoded audio, if available, or uses the latest packet from the encoded version of the local signal. Whichever packet is used is then processed with the unencoded version of the local signal (e.g., the local signal before encoding).

In a binaural ear-to-ear streaming context, the process flow 400 does not increase the computational complexity and does not increase the latency. This is because the process flow 400 selects one of the packets to decode and substituting the encoded local signal packet for the received encoded packet stream 408 only changes the input to the ADPCM decoder. Another operation of the process flow 400 can include making sure that the locally encoded signal is not discarded too soon (e.g., storing it in memory 210), which does not add to the computational complexity. In an example, the time the locally acquired signal frame is received can correspond to a time the dropped packet was encoded at the second hearing assistance device (e.g., a time in the encoded packet stream 408). In other words, the time the local signal frame was acquired and the time the dropped packet would have been originally recorded by the second hearing device can correspond (e.g., be identical, substantially identical, relate with a known offset etc.).

Figure 5:
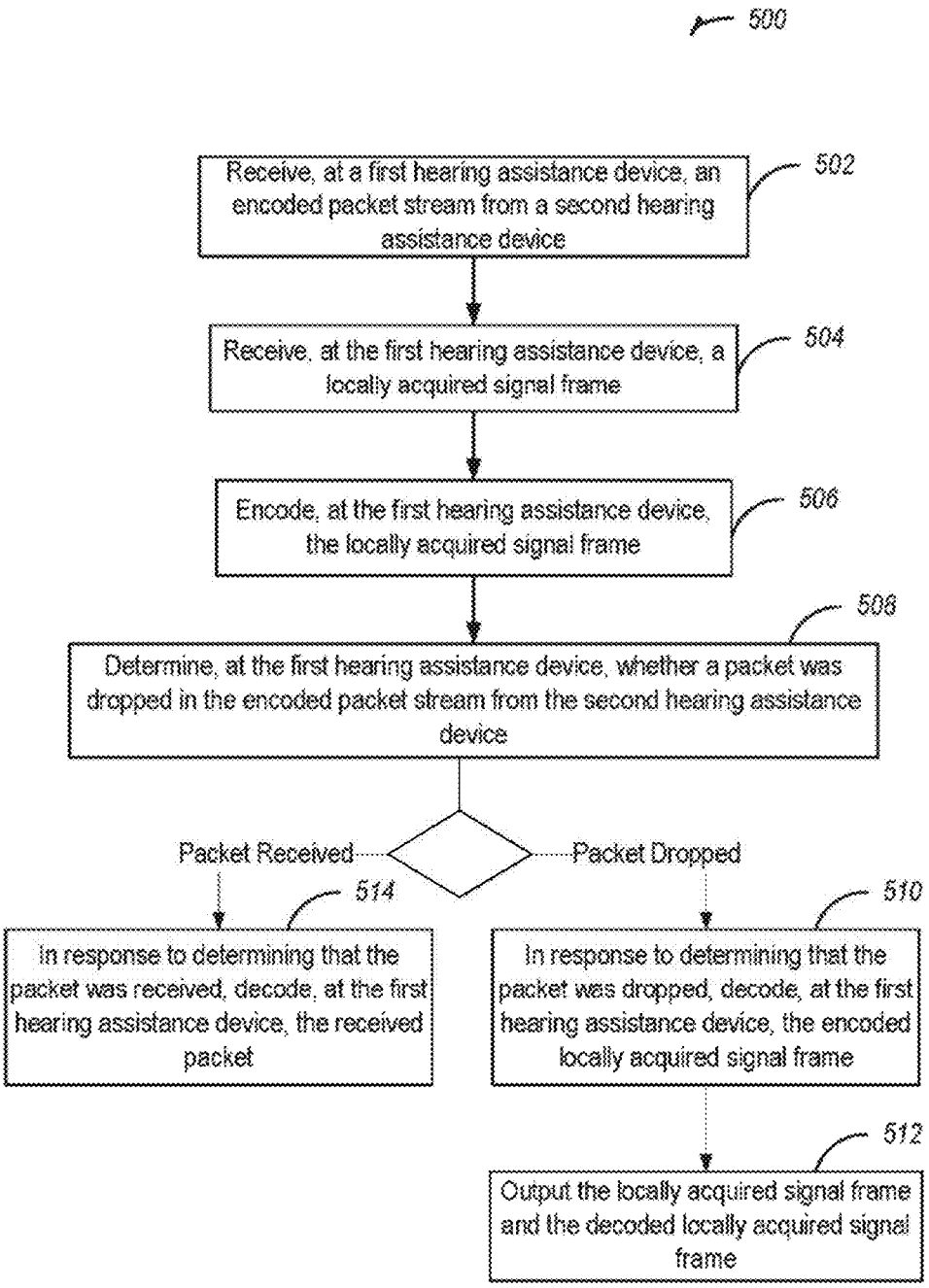
FIG. 5 illustrates generally a flowchart for a packet loss concealment technique in accordance with various embodiments of the present subject matter.

The dashed-line in the process flow 400 represents additional information that the decoder can use to reduce discontinuities if present. For example, certain components (e.g. quantizer scale adaptation) can be modified to lower the likelihood of audible artifacts appearing in the encoded locally acquired signal frame at the cost of a potentially poorer quality (for the duration of the frame). The encoded locally acquired signal frame can include a single-channel or a multi-channel audio signal. FIG. 5 illustrates generally a flowchart for a packet loss concealment technique 500 in accordance with some embodiments of the present subject matter. The technique 500 includes an operation 502 to receive, at a first hearing assistance device, an encoded packet stream from a second hearing assistance device. The technique 500 includes an operation 504 to receive, at the first hearing assistance device, a locally acquired signal frame. The technique 500 includes an operation 506 to encode, at the first hearing assistance device, the locally acquired signal frame. Operation 506 can include encoding the locally acquired signal frame with adaptive differential pulse-code modulation (ADPCM). The technique 500 includes an operation 508 to determine, at the first hearing assistance device, whether a packet was dropped in the encoded packet stream from the second hearing assistance device. The technique 500 includes an operation 510 to, in response to determining that the packet was dropped, decode, at the first hearing assistance device, the encoded locally acquired signal frame. In another example, the technique 500 includes an operation 514, in response to determining that the packet was received (i.e., not dropped), decoding the received packet and outputting the locally acquired signal frame and the decoded packet. The technique 500 includes an operation 512 to output the locally acquired signal frame and the decoded locally acquired signal frame.

In an example, the technique 500 includes storing the encoded locally acquired signal frame in memory on the first hearing assistance device. In another example, the technique 500 includes processing the locally acquired signal frame and the decoded locally acquired signal frame into an audio output and playing, at the first hearing assistance device, the audio output. In yet another example, the locally acquired signal frame is received at a time corresponding to a time of the dropped packet in the encoded packet stream.

Although packet loss concealment of the present subject matter has been discussed with respect to packet loss in ear-to-ear communication, it can be used in any scenario where the signal of a local microphone is similar to the signal of the microphone that is being transmitted, such as with a remote microphone and an ad-hoc microphone array.

In the remote microphone case, the signal of a microphone (positioned closer to the target of interest) is transmitted to the hearing assistance device and the signal is played instead of or combined with the normal hearing assistance device signal. In this example, there is similarity between the signals of the two microphones and the binaural packet loss concealment of the present subject matter can help to mask artifacts caused by packet loss.

In the ad-hoc microphone array case, the signals of multiple microphones are combined to improve the signal-to-noise ratio (SNR) of microphone signal. These techniques rely on a high correlation in the target speech in the different microphone signals, and further rely on a lack of or opposite correlation in the noise. Therefore, the binaural packet loss concealment of the present subject matter can help to mask artifacts caused by this packet loss.

The packet loss concealment of the present subject matter can use the local microphone signal if the remote microphone signal is not available. In one embodiment, the microphones have clock synchronization, as packet loss concealment is improved if the two microphone signals are well synchronized, for instance with a technique as described in U.S. patent application Ser. No. 13/683,986, titled "Method and apparatus for synchronizing hearing instruments via wireless communication", which is hereby incorporated by reference herein in its entirety.

Figure 6:
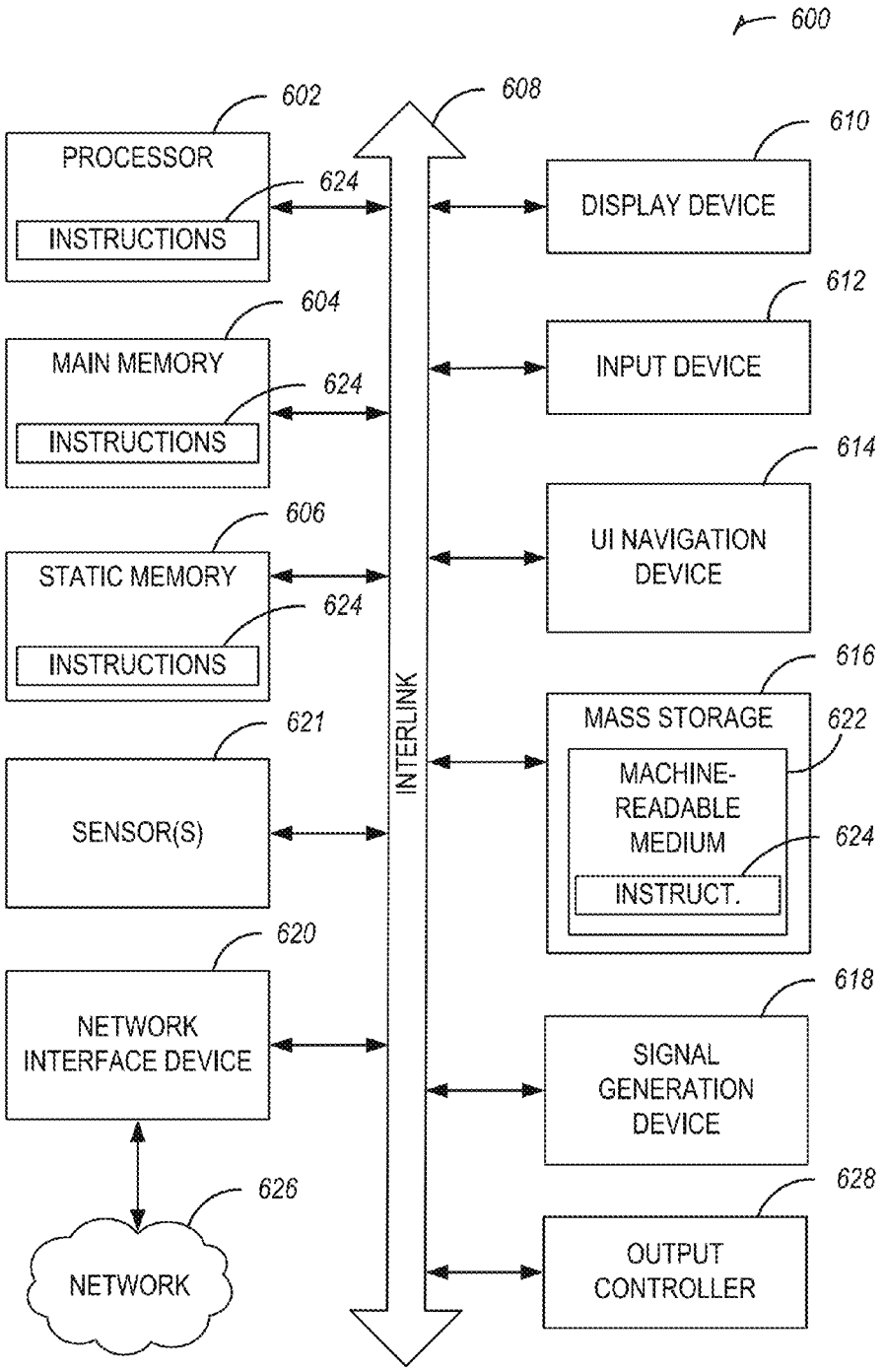
FIG. 6 illustrates generally an example of a block diagram of a machine upon which any one or more of the techniques discussed herein can perform, in accordance with various embodiments of the present subject matter.

FIG. 6 illustrates generally an example of a block diagram of a machine 600 upon which any one or more of the techniques discussed herein can perform in accordance with some embodiments of the present subject matter. In various embodiments, the machine 600 can operate as a standalone device or can be connected (e.g., networked) to other machines. The machine can include a processor in a hearing assistance device, such as processor 208 in FIG. 2. In a networked deployment, the machine 600 can operate in the capacity of a server machine, a client machine, or both in server-client network environments. In an example, the machine 600 can act as a peer machine in peer-to-peer (P2P) (or other distributed) network environment. The machine 600 can be a personal computer (PC), a tablet PC, a set-top box (STB), a personal digital assistant (PDA), a mobile telephone, a web appliance, a network router, switch or bridge, or any machine capable of executing instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein, such as cloud computing, software as a service (SaaS), other computer cluster configurations.

Examples, as described herein, can include, or can operate on, logic or a number of components, modules, or mechanisms. Modules are tangible entities (e.g., hardware) capable of performing specified operations when operating. A module includes hardware. In an example, the hardware can be specifically configured to carry out a specific operation (e.g., hardwired). In an example, the hardware can include configurable execution units (e.g., transistors, circuits, etc.) and a computer readable medium containing instructions, where the instructions configure the execution units to carry out a specific operation when in operation. The configuring can occur under the direction of the executions units or a loading mechanism. Accordingly, the execution units are communicatively coupled to the computer readable medium when the device is operating. In this example, the execution units can be a member of more than one module. For example, under operation, the execution units can be configured by a first set of instructions to implement a first module at one point in time and reconfigured by a second set of instructions to implement a second module.

Machine (e.g., computer system) 600 can include a hardware processor 602 (e.g., a central processing unit (CPU), a graphics processing unit (GPU), a hardware processor core, or any combination thereof), a main memory 604 and a static memory 606, some or all of which can communicate with each other via an interlink (e.g., bus) 608. The machine 600 can further include a display unit 610, an alphanumeric input device 612 (e.g., a keyboard), and a user interface (UI) navigation device 614 (e.g., a mouse). In an example, the display unit 610, alphanumeric input device 612 and UI navigation device 614 can be a touch screen display. The machine 600 can additionally include a storage device (e.g., drive unit) 616, a signal generation device 618 (e.g., a speaker), a network interface device 620, and one or more sensors 621, such as a global positioning system (GPS) sensor, compass, accelerometer, or other sensor. The machine 600 can include an output controller 628, such as a serial (e.g., universal serial bus (USB), parallel, or other wired or wireless (e.g., infrared (IR), near field communication (NFC), etc.) connection to communicate or control one or more peripheral devices (e.g., a printer, card reader, etc.).

The storage device 616 can include a machine readable medium 622 that is non-transitory on which is stored one or more sets of data structures or instructions 624 (e.g., software) embodying or utilized by any one or more of the techniques or functions described herein. The instructions 624 can also reside, completely or at least partially, within the main memory 604 (such as memory 210 in FIG. 2), within static memory 606, or within the hardware processor 602 during execution thereof by the machine 600. In an example, one or any combination of the hardware processor 602, the main memory 604, the static memory 606, or the storage device 616 can constitute machine readable media.

While the machine readable medium 622 is illustrated as a single medium, the term "machine readable medium" can include a single medium or multiple media (e.g., a centralized or distributed database, and/or associated caches and servers) configured to store the one or more instructions 624.

The term "machine readable medium" can include any medium that is capable of storing, encoding, or carrying instructions for execution by the machine 600 and that cause the machine 600 to perform any one or more of the techniques of the present disclosure, or that is capable of storing, encoding or carrying data structures used by or associated with such instructions. Non-limiting machine readable medium examples can include solid-state memories, and optical and magnetic media. Specific examples of massed machine readable media can include: non-volatile memory, such as semiconductor memory devices (e.g., Electrically Programmable Read-Only Memory (EPROM), Electrically Erasable Programmable Read-Only Memory (EEPROM)) and flash memory devices; magnetic disks, such as internal hard disks and removable disks; magneto-optical disks; and CD-ROM and DVD-ROM disks.

The instructions 624 can further be transmitted or received over a communications network 626 using a transmission medium via the network interface device 620 utilizing any one of a number of transfer protocols (e.g., frame relay, internet protocol (IP), transmission control protocol (TCP), user datagram protocol (UDP), hypertext transfer protocol (HTTP), etc.). Example communication networks can include a local area network (LAN), a wide area network (WAN), a packet data network (e.g., the Internet), mobile telephone networks (e.g., cellular networks), Plain Old Telephone (POTS) networks, and wireless data networks (e.g., Institute of Electrical and Electronics Engineers (IEEE) 802.11 family of standards known as Wi-Fi®, IEEE 802.16 family of standards known as WiMax®), IEEE 802.15.4 family of standards, peer-to-peer (P2P) networks, among others. In an example, the network interface device 620 can include one or more physical jacks (e.g., Ethernet, coaxial, or phone jacks) or one or more antennas to connect to the communications network 626. In an example, the network interface device 620 can include a plurality of antennas to wirelessly communicate using at least one of single-input multiple-output (SIMO), multiple-input multiple-output (MIMO), or multiple-input single-output (MISO) techniques.

Hearing assistance devices typically include at least one enclosure or housing, a microphone, hearing assistance device electronics including processing electronics, and a speaker or "receiver." Hearing assistance devices can include a power source, such as a battery. In various embodiments, the battery is rechargeable. In various embodiments multiple energy sources are employed. It is understood that in various embodiments the microphone is optional. It is understood that in various embodiments the receiver is optional. It is understood that variations in communications protocols, antenna configurations, and combinations of components can be employed without departing from the scope of the present subject matter. Antenna configurations can vary and can be included within an enclosure for the electronics or be external to an enclosure for the electronics. Thus, the examples set forth herein are intended to be demonstrative and not a limiting or exhaustive depiction of variations.

It is understood that digital hearing assistance devices include a processor. In digital hearing assistance devices with a processor, programmable gains can be employed to adjust the hearing assistance device output to a wearer's particular hearing impairment. The processor can be a digital signal processor (DSP), microprocessor, microcontroller, other digital logic, or combinations thereof. The processing can be done by a single processor, or can be distributed over different devices. The processing of signals referenced in this application can be performed using the processor or over different devices. Processing can be done in the digital domain, the analog domain, or combinations thereof. Processing can be done using subband processing techniques. Processing can be done using frequency domain or time domain approaches. Some processing can involve both frequency and time domain aspects. For brevity, in some examples drawings can omit certain blocks that perform frequency synthesis, frequency analysis, analog-to-digital conversion, digital-to-analog conversion, amplification, buffering, and certain types of filtering and processing. In various embodiments of the present subject matter the processor is adapted to perform instructions stored in one or more memories, which can or cannot be explicitly shown. Various types of memory can be used, including volatile and nonvolatile forms of memory. In various embodiments, the processor or other processing devices execute instructions to perform a number of signal processing tasks. Such embodiments can include analog components in communication with the processor to perform signal processing tasks, such as sound reception by a microphone, or playing of sound using a receiver (i.e., in applications where such transducers are used). In various embodiments of the present subject matter, different realizations of the block diagrams, circuits, and processes set forth herein can be created by one of skill in the art without departing from the scope of the present subject matter.

Various embodiments of the present subject matter support wireless communications with a hearing assistance device. In various embodiments the wireless communications can include standard or nonstandard communications. Some examples of standard wireless communications include, but not limited to, Bluetooth™, low energy Bluetooth, IEEE 802.11 (wireless LANs), 802.15 (WPANs), and 802.16 (WiMAX). Cellular communications can include, but not limited to, CDMA, GSM, ZigBee, and ultra-wideband (UWB) technologies. In various embodiments, the communications are radio frequency communications. In various embodiments the communications are optical communications, such as infrared communications. In various embodiments, the communications are inductive communications. In various embodiments, the communications are ultrasound communications. Although embodiments of the present system can be demonstrated as radio communication systems, it is possible that other forms of wireless communications can be used. It is understood that past and present standards can be used. It is also contemplated that future versions of these standards and new future standards can be employed without departing from the scope of the present subject matter.

The wireless communications support a connection from other devices. Such connections include, but are not limited to, one or more mono or stereo connections or digital connections having link protocols including, but not limited to 802.3 (Ethernet), 802.4, 802.5, USB, ATM, Fibre-channel, Firewire or 1394, InfiniBand, or a native streaming interface. In various embodiments, such connections include all past and present link protocols. It is also contemplated that future versions of these protocols and new protocols can be employed without departing from the scope of the present subject matter.

It is further understood that different hearing assistance devices can embody the present subject matter without departing from the scope of the present disclosure. The devices depicted in the figures are intended to demonstrate the subject matter, but not necessarily in a limited, exhaustive, or exclusive sense. It is also understood that the present subject matter can be used with a device designed for use in the right ear or the left ear or both ears of the wearer.

The present subject matter is demonstrated for hearing assistance devices, including hearing assistance devices, including but not limited to, behind-the-ear (BTE), in-the-ear (ITE), in-the-canal (ITC), receiver-in-canal (RIC), invisible-in-canal (IIC) or completely-in-the-canal (CIC) type hearing assistance devices. It is understood that behind-the-ear type hearing assistance devices can include devices that reside substantially behind the ear or over the ear. Such devices can include hearing assistance devices with receivers associated with the electronics portion of the behind-the-ear device, or hearing assistance devices of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices and such as deep insertion devices having a transducer, such as a receiver or microphone, whether custom fitted, standard fitted, open fitted and/or occlusive fitted. It is understood that other hearing assistance devices not expressly stated herein can be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code can form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

What is claimed is:

1. A hearing assistance device comprising:

a transceiver programmed to receive an encoded packet stream from a second hearing assistance device; and a processor connected to the transceiver, the processor configured to:

encode a locally acquired signal frame;

determine whether a packet was dropped in the encoded packet stream from the second hearing assistance device;

in response to determining that the packet was dropped, decode the encoded locally acquired signal frame; and output an audio signal based on the decoded locally acquired signal frame, wherein the locally acquired signal frame is received at a specified time corresponding to a time of the dropped packet in the encoded packet stream.

2. The hearing assistance device of claim 1, wherein the processor is configured to decode the packet in response to determining that the packet was received and output the locally acquired signal frame and the decoded packet.

3. The hearing assistance device of claim 1, wherein the transceiver is further configured to transmit the encoded locally acquired signal frame to the second hearing assistance device.

4. The hearing assistance device of claim 3, wherein the encoded locally acquired signal frame includes a single-channel or a multi-channel audio signal.

5. The heating assistance device of claim 1, wherein to encode the locally acquired signal frame, the processor is to encode the locally acquired signal frame with adaptive differential pulse-code modulation (ADPCM).

6. The hearing assistance device of claim 1, further comprising memo to store the encoded locally acquired signal frame.

7. The hearing assistance device of claim 1, wherein the processor is configured to adapt a quantizer scale to lower a likelihood of audible artifacts in the decoded locally acquired signal frame.

8. The hearing assistance device of claim 1, further comprising a speaker to play the output frames.

9. The hearing assistance device of claim 1, wherein the hearing assistance device includes a completely-in-canal (CIC) hearing aid, an in-the-canal (ITC) hearing aid, an in-the-ear (ITE) hearing aid, or a receiver-in-canal (RIC) hearing aid.

10. The hearing assistance device of claim 1, wherein the hearing assistance device includes a behind-the-ear (BTE) hearing aid.

11. A method for packet loss concealment comprising:

receiving, at a first hearing assistance device, an encoded packet stream from a second hearing assistance device;

encoding, at the first hearing assistance device, a locally acquired signal frame;

determining, at the first hearing assistance device, whether a packet was dropped in the encoded packet stream from the second hearing assistance device;

in response to determining that the packet was dropped, decoding, at the first hearing assistance device, the encoded locally acquired signal frame; and outputting an audio signal based on the decoded locally acquired signal frame, wherein the locally acquired signal frame is received at a specified time corresponding to a time of the dropped packet in the encoded packet stream.

12. The method of claim 11, further comprising, in response to determining that the packet was received, decoding the packet and outputting the locally acquired signal frame and the decoded packet.

13. The method of claim 11, wherein encoding the locally acquired signal frame includes encoding the locally acquired signal frame with adaptive differential pulse-code modulation (ADPCM).

14. The method of claim 11, further comprising storing the encoded locally acquired signal frame in memory on the first hearing assistance device.

15. The method of claim 11, further comprising processing the locally acquired signal frame and the decoded locally acquired signal frame into an audio output and playing, at the first hearing assistance device, the audio output.

16. At least one machine-readable medium including instructions for receiving information, which when executed by a machine, cause the machine to:

receive, at a first hearing assistance device, an encoded packet stream from a second hearing assistance device;

encode at the first hearing assistance device, a locally acquired signal frame;

determine, at the first hearing assistance device, whether a packet was dropped in the encoded packet stream from the second hearing assistance device;

in response to determining that the packet was dropped, decoding, at the first hearing assistance device, the encoded locally acquired signal frame; and output an audio signal based on the decoded locally acquired signal frame, wherein the locally acquired signal frame is received at a specified time corresponding to a time of the dropped packet in the encoded packet stream.

17. The machine-readable medium of claim 16, wherein instructions to encode the locally acquired signal frame include instructions to encode the locally acquired signal frame with adaptive differential pulse-code modulation (ADPCM).

18. The machine-readable medium of claim 16, further comprising instructions to store the encoded locally acquired signal frame in memory on the first hearing assistance device.

19. The machine-readable medium of claim 16, further comprising instructions to:

process the locally acquired signal frame and the decoded locally acquired signal frame into an audio output; and play, at the first hearing assistance device, the audio output.

20. A hearing assistance device comprising:

a transceiver programmed to receive an encoded packet stream from a second hearing assistance device; and a processor connected to the transceiver; the processor configured to:

encode a locally acquired signal frame;

determine whether a packet was dropped in the encoded packet stream from the second hearing assistance device;

in response to determining that the packet was dropped, decode the encoded locally acquired signal frame; and output an audio signal based on the decoded locally acquired signal frame, wherein the processor is configured to adapt a quantizer scale to lower a likelihood of audible artifacts in the decoded locally acquired signal frame.

* * * * *